US011295918B2

(12) United States Patent
Kawaguchi et al.

(10) Patent No.: US 11,295,918 B2
(45) Date of Patent: Apr. 5, 2022

(54) ELECTROMAGNETIC RELAY

(71) Applicant: OMRON Corporation, Kyoto (JP)

(72) Inventors: Naoki Kawaguchi, Yame (JP); Ryota Minowa, Yamaga (JP); Hiroyuki Harimochi, Kumamoto (JP); Shinichi Ogawa, Kikuchi (JP); Kohei Otsuka, Omuta (JP); Hiroyuki Iwasaka, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 89 days.

(21) Appl. No.: 17/012,058

(22) Filed: Sep. 4, 2020

(65) Prior Publication Data

US 2021/0082651 A1 Mar. 18, 2021

(30) Foreign Application Priority Data

Sep. 13, 2019 (JP) ..... JP2019-167425

(51) Int. Cl.

| | |
|---|---|
| ***H01H 9/00*** | (2006.01) |
| ***H01H 50/54*** | (2006.01) |
| ***H01H 50/42*** | (2006.01) |
| ***H01H 50/14*** | (2006.01) |
| ***H01H 50/10*** | (2006.01) |
| *H01H 50/20* | (2006.01) |

(52) U.S. Cl.

CPC ..... *H01H 50/546* (2013.01); *H01H 50/10* (2013.01); *H01H 50/14* (2013.01); *H01H 50/42* (2013.01); *H01H 50/20* (2013.01)

(58) Field of Classification Search

CPC ..... H01H 50/546; H01H 50/10; H01H 50/14; H01H 50/42; H01H 50/20; H01H 1/54; H01H 50/54

USPC ..... 335/179

See application file for complete search history.

(56) References Cited

U.S. PATENT DOCUMENTS

| | | | | |
|---|---|---|---|---|
| 4,041,424 A * | 8/1977 | Harris | G04F 3/06 | 335/75 |
| 4,710,740 A * | 12/1987 | Dennison | H01F 7/12 | 335/132 |
| 5,546,061 A * | 8/1996 | Okabayashi | H01H 9/443 | 335/126 |
| 6,377,143 B1 * | 4/2002 | Zhou | H01H 50/546 | 218/154 |

(Continued)

FOREIGN PATENT DOCUMENTS

| | | |
|---|---|---|
| JP | 2015-46373 A | 3/2015 |
| JP | 6358442 B2 | 6/2018 |

*Primary Examiner* — Shawki S Ismail
*Assistant Examiner* — Lisa N Homza
(74) *Attorney, Agent, or Firm* — Shinjyu Global IP

(57) ABSTRACT

A first fixed terminal includes a first support portion and a first extending portion. The first support portion is located in a closing direction with respect to a movable contact piece. The first support portion supports a first fixed contact. The first support portion extends from the first fixed contact in a first lateral direction. The first lateral direction is one direction in a longitudinal direction of the movable contact piece. The first extending portion is connected to the first support portion. The first extending portion extends in the closing direction from the first support portion. The first extending portion is disposed apart from the movable contact piece in the first lateral direction.

10 Claims, 13 Drawing Sheets

(56) References Cited

U.S. PATENT DOCUMENTS 8,164,404 B2 * 4/2012 Kamiya ..... H01H 9/047 335/201
8,570,125 B2 * 10/2013 Suzuki ..... H01H 50/546 335/185
2009/0288935 A1 * 11/2009 Larcher ..... H01H 50/14 200/275
2014/0014622 A1 * 1/2014 Naka ..... H01H 9/443 218/4
2015/0034600 A1 * 2/2015 Isozaki ..... H01H 9/443 218/148
2015/0048908 A1 * 2/2015 Isozaki ..... H01H 71/10 335/6
2015/0213981 A1 * 7/2015 Choi ..... H01H 50/30 335/185
2015/0213985 A1 * 7/2015 Naka ..... H01H 50/42 335/189
2015/0213986 A1 * 7/2015 Naka ..... H01H 50/42 335/189
2016/0155592 A1 6/2016 Ito et al.
2019/0006140 A1 * 1/2019 Shi ..... H01H 50/546
2019/0035586 A1 1/2019 Ito et al.
2019/0131094 A1 * 5/2019 Minowa ..... H01H 50/14
2019/0131095 A1 * 5/2019 Minowa ..... H01H 50/443
2019/0131096 A1 * 5/2019 Minowa ..... H01H 50/641
2019/0304724 A1 * 10/2019 Minowa ..... H01H 1/62
2019/0304726 A1 * 10/2019 Ishikawa ..... H01H 50/18
2019/0304729 A1 * 10/2019 Minowa ..... H01H 50/58
2019/0311871 A1 * 10/2019 Minowa ..... H01H 50/546
2020/0176208 A1 * 6/2020 Mori ..... H01H 50/42
2020/0176209 A1 * 6/2020 Kubono ..... H01H 50/14
2020/0312597 A1 * 10/2020 Ito ..... H01H 50/20
2021/0082651 A1 * 3/2021 Kawaguchi ..... H01H 50/14
2021/0202198 A1 * 7/2021 Hayashida ..... H01H 50/026
2021/0296070 A1 * 9/2021 Kawaguchi ..... H01H 50/14
2021/0304991 A1 * 9/2021 Otsuka ..... H01H 1/20
2021/0304994 A1 * 9/2021 Mori ..... H01H 50/14
2021/0327671 A1 * 10/2021 Mori ..... H01H 50/64

* cited by examiner

X1 ⟷ X2

X1 ⟷ X2

ELECTROMAGNETIC RELAY

CROSS-REFERENCE TO RELATED APPLICATION

This application claims priority to Japanese Patent Application No. 2019-167425, filed Sep. 13, 2019. The contents of that application are incorporated by reference herein in their entirety.

FIELD

The present invention relates to an electromagnetic relay.

BACKGROUND

Some electromagnetic relays include a movable contact piece, a first fixed terminal, and a second fixed terminal (see, for example, Japanese Patent No. 6358442 and Japanese Patent Laid-Open No. 2015-46373). A first movable contact and a second movable contact are connected to the movable contact piece. A first fixed contact is connected to the first fixed terminal. A second fixed contact is connected to the second fixed terminal.

SUMMARY

FIG. 12 is a diagram illustrating an example of an electromagnetic relay including a movable contact piece 101, a first fixed terminal 102, and a second fixed terminal 103. In the electromagnetic relay illustrated in FIG. 12, the movable contact piece 101 is disposed below the first fixed terminal 102 and the second fixed terminal 103. The first fixed terminal 102 and the second fixed terminal 103 extend upward from a position facing the movable contact piece 101. In this electromagnetic relay, when a current flows from the first fixed terminal 102 through the movable contact piece 101 to the second fixed terminal 103, a magnetic field is generated above and below the movable contact piece 101. In this case, a magnetic flux density B1 above the movable contact piece 101 is higher than a magnetic flux density B2 below the movable contact piece 101. Therefore, the Lorentz force acts on the movable contact piece 101 in an opening direction (downward direction in FIG. 12). As a result, the contact force at the contact is weakened.

FIG. 13 is a diagram showing another example of an electromagnetic relay including a movable contact piece 201, a first fixed terminal 202, and a second fixed terminal 203. In the electromagnetic relay illustrated in FIG. 13, the movable contact piece 201 is disposed between the first fixed terminal 202 and the second fixed terminal 203. Therefore, even if a magnetic flux density B1 above the movable contact piece 201 is larger than a magnetic flux density B2 below the movable contact piece 201, the Lorentz force acts on the movable contact piece 201 in the closing direction (downward direction in FIG. 13). Therefore, it is possible to prevent the contact force at the contact from being weakened. However, in the electromagnetic relay illustrated in FIG. 13, when assembling the electromagnetic relay, the movable contact piece 201 easily interferes with the first fixed terminal 202 and the second fixed terminal 203, thus impairing the assemblability.

It is an object of the present disclosure to suppress a decrease in contact force at the contact in an electromagnetic relay as well as improving the assemblability thereof.

An electromagnetic relay according to one aspect of the present disclosure includes a movable contact piece, a first movable contact, a second movable contact, a first fixed contact, a second fixed contact, a first fixed terminal, and a second fixed terminal. The movable contact piece is movable in a closing direction and an opening direction which is opposite to the closing direction. The first movable contact is connected to the movable contact piece. The second movable contact is connected to the movable contact piece. The first fixed contact is disposed to face the first movable contact in the closing direction. The second fixed contact is disposed to face the second movable contact in the closing direction. The first fixed terminal is connected to the first fixed contact. The second fixed terminal is connected to the second fixed contact.

The first fixed terminal includes a first support portion and a first extending portion. The first support portion is located in the closing direction with respect to the movable contact piece. The first support portion supports the first fixed contact. The first support portion extends from the first fixed contact in a first lateral direction. The first lateral direction is one direction in the longitudinal direction of the movable contact piece. The first extending portion is connected to the first support portion. The first extending portion extends from the first support portion in the closing direction. The first extending portion is disposed apart from the movable contact piece in the first lateral direction. The second fixed terminal includes a second support portion and a second extending portion. The second support portion is located in the closing direction with respect to the movable contact piece. The second support portion supports the second fixed contact. The second support portion extends from the second fixed contact in a second lateral direction. The second lateral direction is one direction in the longitudinal direction of the movable contact piece. The second extending portion is connected to the second support portion. The second extending portion extends from the second support portion in the closing direction. The second extending portion is disposed apart from the movable contact piece in the second lateral direction.

In the electromagnetic relay according to the present aspect, the first extending portion of the first fixed terminal is disposed apart from the movable contact piece in the first lateral direction. The second extending portion of the second fixed terminal is disposed apart from the movable contact piece in the second lateral direction. Therefore, the distance between the first extending portion and the second extending portion becomes large. As a result, the Lorentz force acting on the movable contact piece in the opening direction is reduced and the decrease of contact force at the contact is suppressed. Further, the first support portion, the first extending portion, the second support portion and the second extending portion are located in the closing direction with respect to the movable contact piece. Therefore, when assembling the electromagnetic relay, the movable contact piece is unlikely to interfere with the first fixed terminal and the second fixed terminal. As a result, the assemblability is improved.

The electromagnetic relay may further include a housing. The housing may house the movable contact piece, the first movable contact, the second movable contact, the first fixed contact, and the second fixed contact. The first fixed terminal may further include a first connection portion and a first external terminal. The first connection portion may be connected to the first extending portion and may extend from the first extending portion in the second lateral direction. The first external terminal may be connected to the first connection portion and may protrude outward of the housing. The second fixed terminal may further include a second connection portion and a second external terminal. The second connection portion may be connected to the second extending portion and may extend from the second extending portion in the first lateral direction. The second external terminal may be connected to the second connection portion and may protrude outward of the housing.

The first connection portion may extend from the first extending portion in the first lateral direction. The second connection portion may extend from the second extending portion in the second lateral direction. The first connection portion may protrude from the housing outward thereof. The second connection portion may protrude from the housing outward thereof.

The electromagnetic relay may further include a first magnet and a second magnet. The first magnet may be disposed so as to cancel the direction of the magnetic flux generated in the first movable contact and the first fixed contact during energization. The second magnet may be disposed so as to cancel the direction of the magnetic flux generated in the second movable contact and the second fixed contact during energization. The electromagnetic relay may further include a first magnetic shield member and a second magnetic shield member. The first magnetic shield member may be disposed between the first extending portion and the movable contact piece in the longitudinal direction of the movable contact piece. The second magnetic shield member may be disposed between the second extending portion and the movable contact piece in the longitudinal direction of the movable contact piece.

In the longitudinal direction of the movable contact piece, the distance between the first extending portion and the second extending portion may be larger than the length of the movable contact piece. The first extending portion may be disposed at a non-overlapping position with the movable contact piece when viewed from the closing direction or the opening direction. The second extending portion may be disposed at a non-overlapping position with the movable contact piece when viewed from the closing direction or the opening direction.

The electromagnetic relay may further include a drive shaft and a drive device. The drive shaft may be connected to the movable contact piece. The drive shaft may extend from the movable contact piece in the opening direction. The drive device may be disposed in the opening direction with respect to the movable contact piece. The drive device may include a movable iron core and a coil. The movable iron core may be connected to the drive shaft. The movable iron core may be movable in the closing direction and the opening direction. The coil may generate an electromagnetic force that moves the movable iron core.

DETAILED DESCRIPTION

Figure 1:
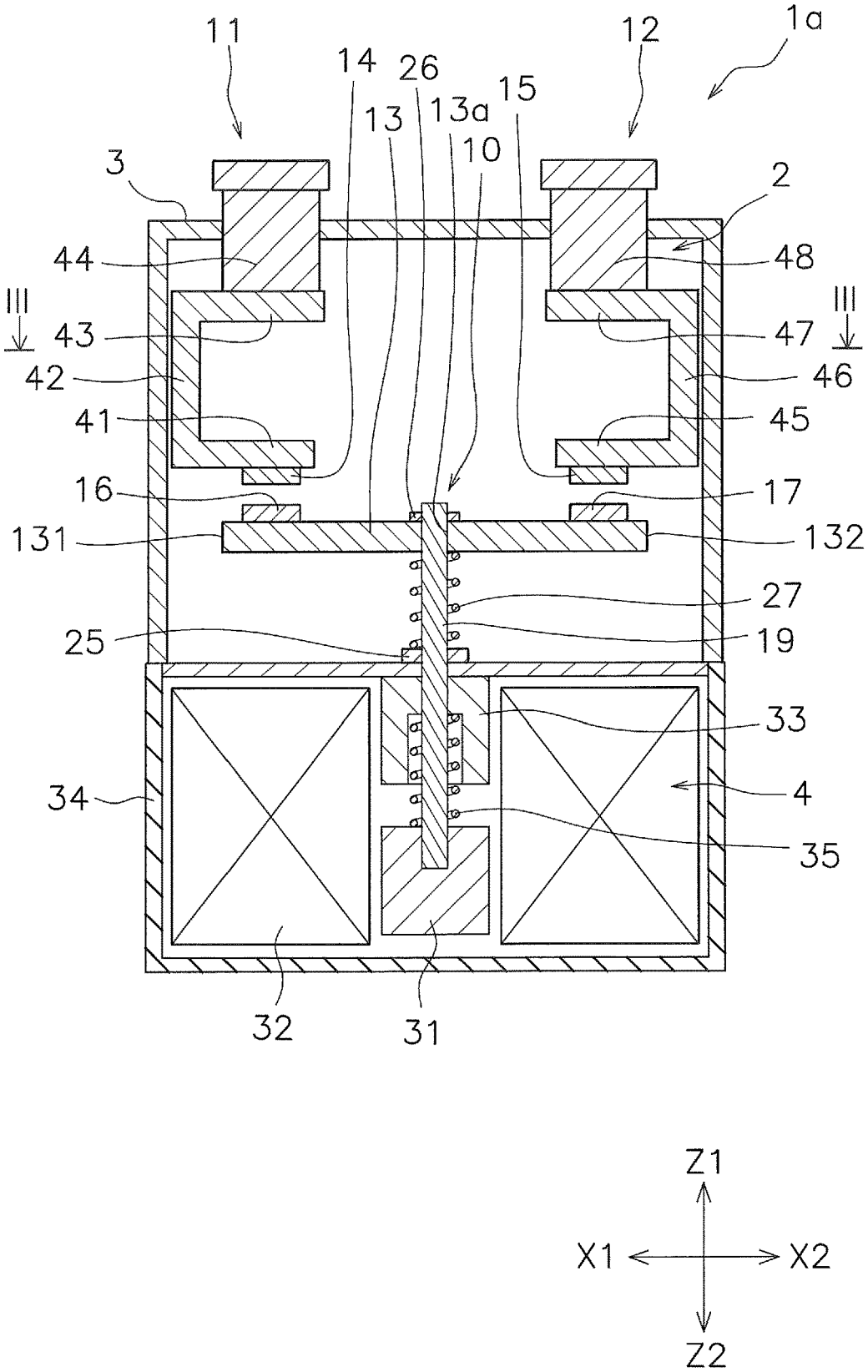
FIG. 1 is a side cross-sectional view illustrating an electromagnetic relay in an open state according to a first embodiment.

Hereinafter, an electromagnetic relay 1*a* according to one embodiment will be described with reference to the drawings. FIG. 1 is a side cross-sectional view illustrating an electromagnetic relay 1*a* according to a first embodiment. As illustrated in FIG. 1, the electromagnetic relay 1*a* includes a contact device 2, a housing 3, and a drive device 4.

In the following description, each of the direction, up(ward), down(ward), left, and right corresponds to up(ward), down(ward), left, and right in FIG. 1. Specifically, the direction from the drive device 4 towards the contact device 2 is defined as up(ward). The direction from the contact device 2 towards the drive device 4 is defined as down(ward). In FIG. 1, the direction perpendicular to an up-down direction is defined as a left-right direction. The direction perpendicular to the up-down direction and the left-right direction is defined as a front-back direction. The front-back direction is a direction perpendicular to the sheet of FIG. 1. However, these directions are defined for the purpose of illustration, and should not be construed to limit the disposal directions of the electromagnetic relay 1*a*.

The contact device 2 is disposed in the housing 3. The contact device 2 includes a movable mechanism 10, a first fixed terminal 11, a second fixed terminal 12, a movable contact piece 13, a first fixed contact 14, a second fixed contact 15, a first movable contact 16, and a second movable contact 17. The first fixed contact 14 is connected to the first fixed terminal 11. The second fixed contact 15 is connected to the second fixed terminal 12. The first fixed contact 14 and the second fixed contact 15 are disposed apart from each other in the left-right direction.

The movable contact piece 13 extends in the left-right direction. In the present embodiment, the longitudinal direction of the movable contact piece 13 is the left-right direction. The movable contact piece 13 is movable in a closing direction Z1 and an opening direction Z2. The closing direction Z1 is a direction in which the movable contact piece 13 approaches the first fixed contact 14 and the second fixed contact 15 (upward in FIG. 1). The opening direction Z2 is a direction in which the movable contact piece 13 separates from the first fixed contact 14 and the second fixed contact 15 (downward in FIG. 1).

The first movable contact 16 and the second movable contact 17 are connected to the movable contact piece 13. The first movable contact 16 and the second movable contact 17 are disposed apart from each other in the left-right direction. The first movable contact 16 faces the first fixed contact 14 in the up-down direction. The second movable contact 17 faces the second fixed contact 15 in the up-down direction. The first fixed contact 14 is disposed in the closing direction Z1 (upward) with respect to the first movable contact 16. The second fixed contact 15 is disposed in the closing direction Z1 (upward) with respect to the second movable contact 17.

The movable mechanism 10 supports the movable contact piece 13. The movable mechanism 10 is disposed so as to be movable in the closing direction Z1 and the opening direction Z2 together with the movable contact piece 13. The movable mechanism 10 includes a drive shaft 19, a first holding member 25, a second holding member 26, and a contact spring 27. The drive shaft 19 extends in the up-down direction. The drive shaft 19 is connected to the movable contact piece 13. The drive shaft 19 extends downward from the movable contact piece 13. The movable contact piece 13 includes a hole 13*a*. The drive shaft 19 is inserted into the hole 13*a*. The movable contact piece 13 is configured to move relative to the drive shaft 19 in the closing direction Z1 and the opening direction Z2.

Figure 2:
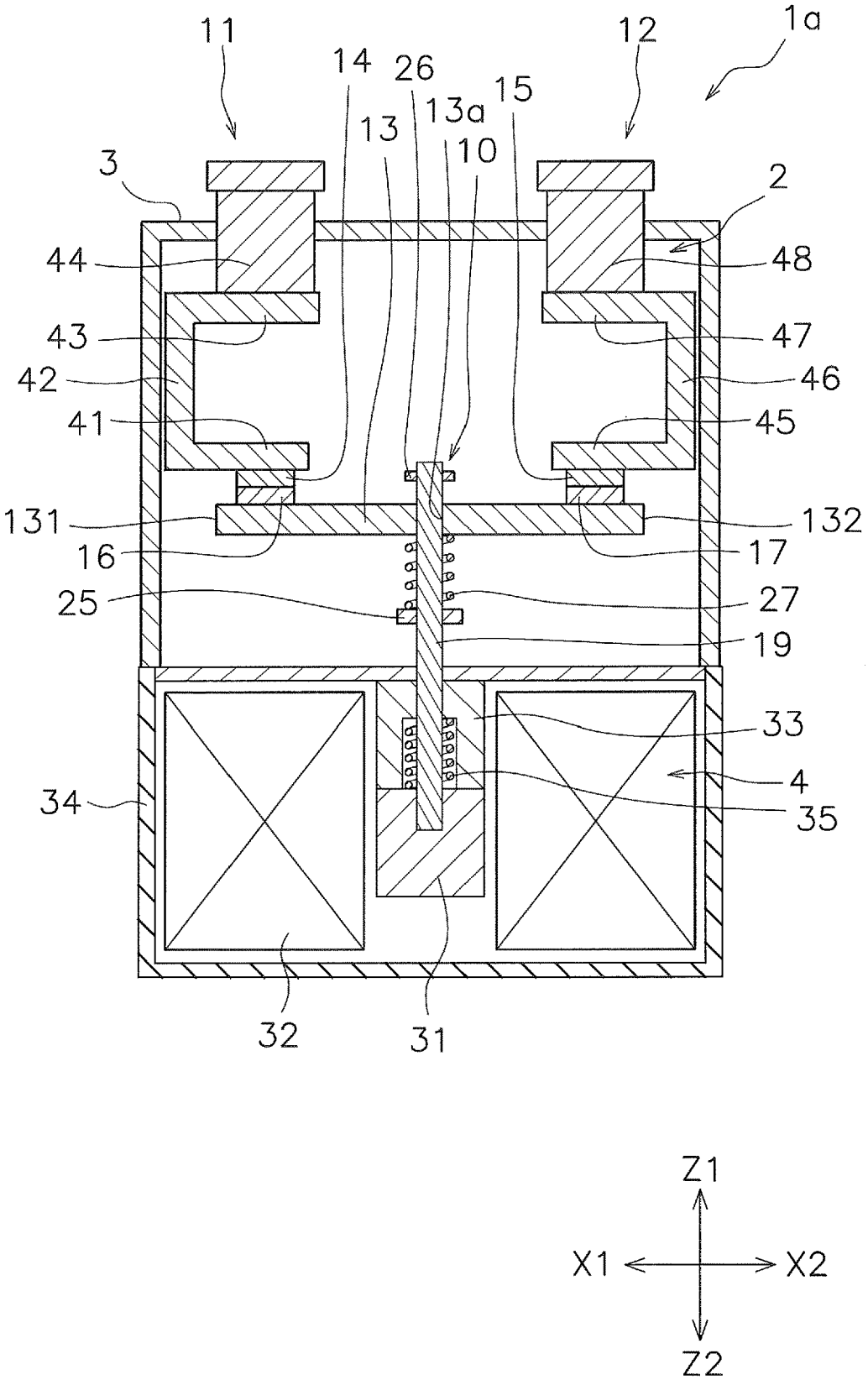
FIG. 2 is a side cross-sectional view illustrating the electromagnetic relay in a closed state.

The drive shaft 19 is configured to move between a closed position and an open position. FIG. 1 shows the drive shaft 19 in the open position. As illustrated in FIG. 1, when the drive shaft 19 is at the open position, the movable contacts 16 and 17 are separated from the fixed contacts 14 and 15. FIG. 2 shows the drive shaft 19 in the closed position. As illustrated in FIG. 2, when the drive shaft 19 is at the closed position, the movable contacts 16 and 17 are in contact with the fixed contacts 14 and 15.

The first holding member 25 is fixed to the drive shaft 19. The contact spring 27 is disposed between the movable contact piece 13 and the first holding member 25. The contact spring 27 urges the movable contact piece 13 in the closing direction Z1 while the movable contacts 16 and 17 are in contact with the fixed contacts 14 and 15. The second holding member 26 is fixed to the drive shaft 19. The movable contact piece 13 is located between the second holding member 26 and the contact spring 27.

The drive device 4 operates the movable contact piece 13 by an electromagnetic force. The drive device 4 moves the movable mechanism 10 in the closing direction Z1 and the opening direction Z2. As a result, the drive device 4 moves the movable contact piece 13 in the closing direction Z1 and the opening direction Z2. The drive device 4 includes a movable iron core 31, a coil 32, a fixed iron core 33, a yoke 34, and a return spring 35.

The movable iron core 31 is connected to the drive shaft 19. The movable iron core 31 is provided so as to be movable in the closing direction Z1 and the opening direction Z2. The coil 32 is energized to generate an electromagnetic force that moves the movable iron core 31 in the closing direction Z1. The fixed iron core 33 is disposed so as to face the movable iron core 31. The return spring 35 is disposed between the movable iron core 31 and the fixed iron core 33. The return spring 35 urges the movable iron core 31 in the opening direction Z2.

The yoke 34 is disposed so as to surround the coil 32. The yoke 34 is disposed on a magnetic circuit formed by the coil 32. The yoke 34 is disposed above, lateral to, and below the coil 32.

Next, the first fixed terminal 11 and the second fixed terminal 12 will be described in detail. As illustrated in FIG. 1, the entire first fixed terminal 11 is located in the closing direction with respect to the movable contact piece 13. The first fixed terminal 11 includes a first support portion 41, a first extending portion 42, a first connection portion 43, and a first external terminal 44. The first support portion 41, the first extending portion 42, and the first connection portion 43 have a plate-like shape. The first external terminal 44 has a cylindrical shape. The first support portion 41, the first extending portion 42, and the first connection portion 43 may be formed integrally. Alternatively, at least a part of the first support portion 41, the first extending portion 42, and the first connection portion 43 may be formed separately.

The first support portion 41 faces the movable contact piece 13. The first support portion 41 is located above the movable contact piece 13. The first fixed contact 14 is connected to the first support portion 41. The first support portion 41 supports the first fixed contact 14. The first support portion 41 extends from the first fixed contact 14 in a first lateral direction X1. The first lateral direction X1 is defined as one direction in the longitudinal direction of the movable contact piece 13. In the present embodiment, the first lateral direction X1 is the left direction in FIG. 1. The movable contact piece 13 includes a first end portion 131 and a second end portion 132 in the longitudinal direction. In the present embodiment, the first end portion 131 is the left end of the movable contact piece 13 and the second end portion 132 is the right end of the movable contact piece 13 in FIG. 1. The first support portion 41 extends beyond the position of the first end portion 131 of the movable contact piece 13 in the longitudinal direction of the movable contact piece 13. In other words, the left end of the first support portion 41 is located leftward of the first end portion 131.

Figure 3:
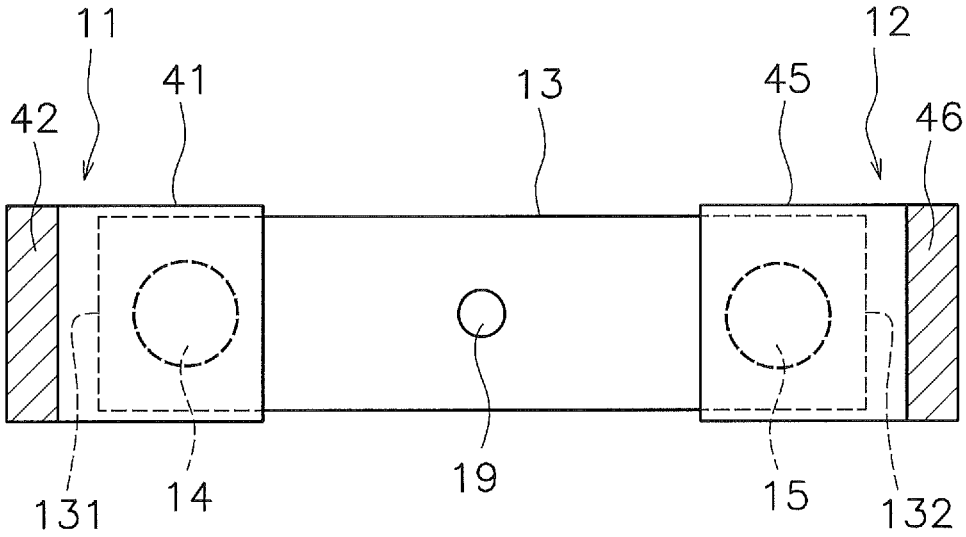
FIG. 3 is a cross-sectional view taken along line III-III of FIG. 1.

The first extending portion 42 is connected to the first support portion 41. The first extending portion 42 extends from the first support portion 41 in the closing direction Z1. The first extending portion 42 is disposed apart from the movable contact piece 13 in the first lateral direction X1. The first extending portion 42 is disposed apart from the contact surface between the first fixed contact 14 and the first movable contact 16 in the first lateral direction X1. FIG. 3 is a sectional view taken along line III-III in FIG. 1. As illustrated in FIG. 3, the first extending portion 42 is disposed at a position so as not to overlap with the movable contact piece 13 when viewed from the closing direction Z1 or the opening direction Z2.

The first connection portion 43 is connected to the first extending portion 42. The first connection portion 43 extends from the upper end of the first extending portion 42 in a second lateral direction X2. The second lateral direction X2 is defined as a direction opposite to the first lateral direction X1 in the longitudinal direction of the movable contact piece 13. In the present embodiment, the second lateral direction X2 is the right direction in FIG. 1. The first external terminal 44 is connected to the first connection portion 43. The first external terminal 44 extends from the first connection portion 43 in the closing direction Z1. The first external terminal 44 protrudes outward of the housing 3.

The entire second fixed terminal 12 is located in the closing direction Z1 with respect to the movable contact piece 13. The second fixed terminal 12 includes a second support portion 45, a second extending portion 46, a second connection portion 47, and a second external terminal 48. The second support portion 45, the second extending portion 46, and the second connection portion 47 have a plate-like shape. The second external terminal 48 has a cylindrical shape. The second support portion 45, the second extending portion 46, and the second connection portion 47 may be formed integrally. Alternatively, at least a part of the second support portion 45, the second extending portion 46, and the second connection portion 47 may be formed separately.

The second support portion 45 faces the movable contact piece 13. The second support portion 45 is located above the movable contact piece 13. The second fixed contact 15 is connected to the second support portion 45. The second support portion 45 supports the second fixed contact 15. The second support portion 45 extends from the second fixed contact 15 in the second lateral direction X2. The second support portion 45 extends from the second fixed contact 15 in a direction away from the first support portion 41. The second support portion 45 extends beyond the position of the second end portion 132 of the movable contact piece 13 in the longitudinal direction of the movable contact piece 13. In other words, the right end of the second support portion 45 is located to the right of the second end portion 132.

The second extending portion 46 is connected to the second support portion 45. The second extending portion 46 extends from the second support portion 45 in the closing direction Z1. The second extending portion 46 is disposed apart from the movable contact piece 13 in the second lateral direction X2. The second extending portion 46 is disposed apart from the contact surface between the second fixed contact 15 and the second movable contact 17 in the second lateral direction X2. As illustrated in FIG. 3, the second extending portion 46 is disposed at a position so as not to overlap with the movable contact piece 13 when viewed from the closing direction Z1 or the opening direction Z2.

The second connection portion 47 is connected to the second extending portion 46. The second connection portion 47 extends from the upper end of the second extending portion 46 in the first lateral direction X1. The second connection portion 47 extends from the upper end of the second extending portion 46 in the direction toward the first connection portion 43. The second external terminal 48 is connected to the second connection portion 47. The second external terminal 48 extends from the second connection portion 47 in the closing direction Z1. The second external terminal 48 protrudes outward of the housing 3.

The first extending portion 42 and the second extending portion 46 are disposed apart from each other in the longitudinal direction of the movable contact piece 13. The first extending portion 42 and the second extending portion 46 are disposed beyond the movable contact piece 13 in the longitudinal direction of the movable contact piece 13. In the longitudinal direction of the movable contact piece 13, the distance between the first extending portion 42 and the second extending portion 46 is larger than the length of the movable contact piece 13. In the longitudinal direction of the movable contact piece 13, the distance between the first support portion 41 and the second support portion 45 is smaller than the length of the movable contact piece 13. In the longitudinal direction of the movable contact piece 13, the distance between the first connection portion 43 and the second connection portion 47 is smaller than the length of the movable contact piece 13.

Next, the operation of the electromagnetic relay 1*a* will be described. When the coil 32 is not energized, the drive device 4 is not excited. In this case, the drive shaft 19 is pressed together with the movable iron core 31 in the opening direction Z2 due to the elastic force of the return spring 35. Therefore, the drive shaft 19 is located at the open position illustrated in FIG. 1. In this state, the movable contact piece 13 is also pressed in the opening direction Z2 via the movable mechanism 10. Therefore, the drive shaft 19 is at the open position and the first movable contact 16 and the second movable contact 17 are separated from the first fixed contact 14 and the second fixed contact 15.

When the coil 32 is energized, the drive device 4 is excited. In this case, the movable iron core 31 moves in the closing direction Z1 against the elastic force of the return spring 35 due to the electromagnetic force of the coil 32. As a result, both the drive shaft 19 and the movable contact piece 13 move in the closing direction Z1. Therefore, as illustrated in FIG. 2, the drive shaft 19 moves to the closed position. As a result, as illustrated in FIG. 2, the drive shaft 19 is at the closed position and the first movable contact 16 and the second movable contact 17 come into contact with the first fixed contact 14 and the second fixed contact 15, respectively.

When the current to the coil 32 is stopped and the coil 32 is demagnetized, the movable iron core 31 is pressed in the opening direction Z2 by the elastic force of the return spring 35. As a result, both the drive shaft 19 and the movable contact piece 13 move in the opening direction Z2. Therefore, as illustrated in FIG. 1, the movable mechanism 10 moves to the open position. As a result, the movable mechanism 10 is at the open position, and the first movable contact 16 and the second movable contact 17 are separated from the first fixed contact 14 and the second fixed contact 15.

In the electromagnetic relay 1*a* according to the present embodiment described above, the first extending portion 42 of the first fixed terminal 11 is disposed apart from the movable contact piece 13 in the first lateral direction X1. The second extending portion 46 of the second fixed terminal 12 is disposed apart from the movable contact piece 13 in the second lateral direction X2. Therefore, the distance between the first extending portion 42 and the second extending portion 46 becomes large. As a result, the Lorentz force acting on the movable contact piece 13 in the opening direction is reduced, so that the decrease of contact force at the contact is suppressed. The first support portion 41, the first extending portion 42, the second support portion 45, and the second extending portion 46 are located in the closing direction Z1 with respect to the movable contact piece 13. Therefore, when assembling the electromagnetic relay 1*a*, the movable contact piece 13 is less likely to interfere with the first fixed terminal 11 and the second fixed terminal 12. As a result, the assemblability is improved.

Figure 4:
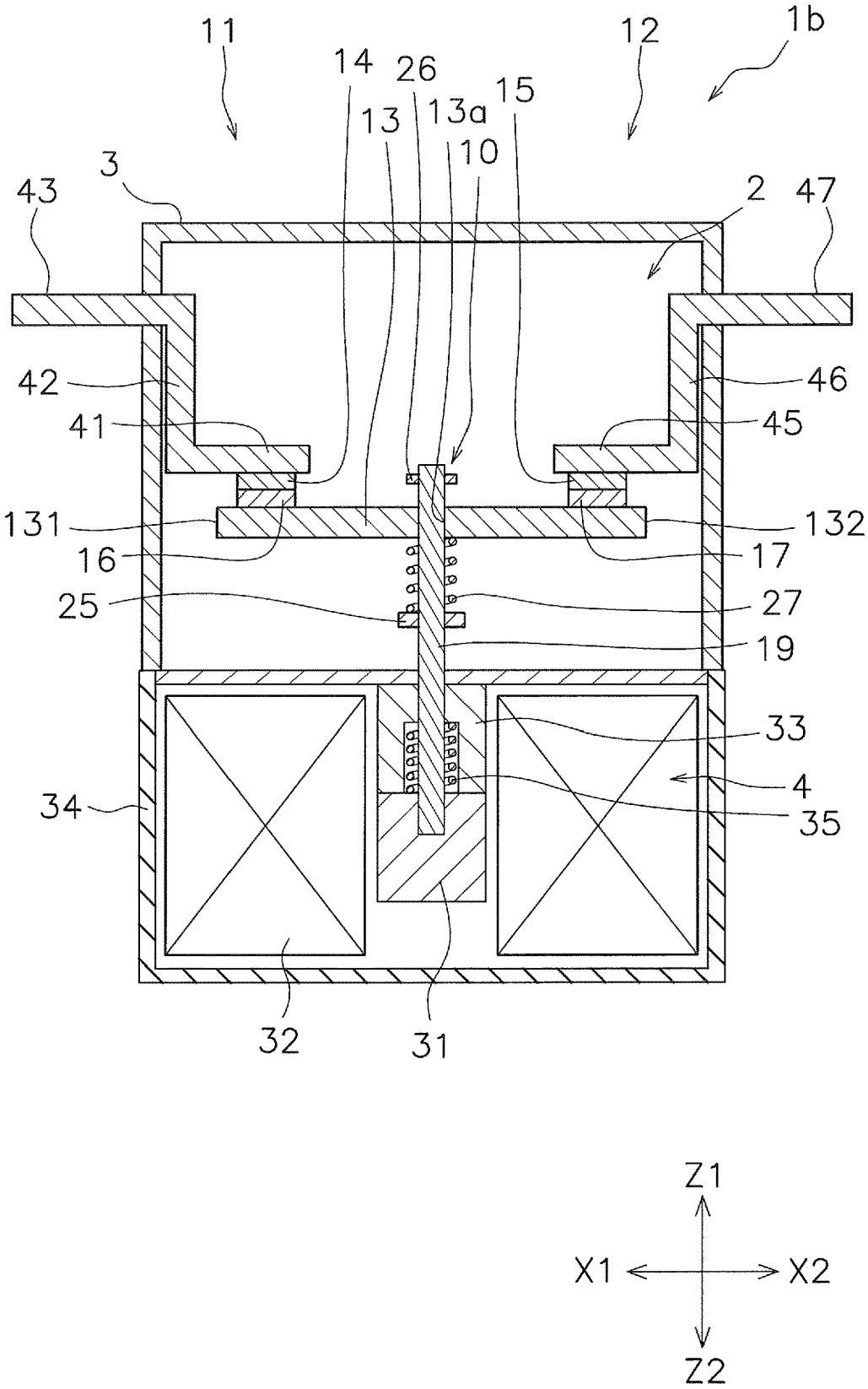
FIG. 4 is a side cross-sectional view illustrating an electromagnetic relay according to a second embodiment.

Next, an electromagnetic relay 1*b* according to the second embodiment will be described. FIG. 4 is a side cross-sectional view of the electromagnetic relay 1*b* according to a second embodiment. Among the configurations of the electromagnetic relay 1*b* according to the second embodiment, configurations that correspond to those of the electromagnetic relay 1*a* according to the first embodiment are denoted by the same reference numerals as the configurations of the electromagnetic relay 1*a* according to the first embodiment.

As illustrated in FIG. 4, the first connection portion 43 of the first fixed terminal 11 extends from the first extending portion 42 in the first lateral direction X1 in the electromagnetic relay 1*b* according to the second embodiment. The second connection portion 47 of the second fixed terminal 12 extends from the second extending portion 46 in the second lateral direction X2. In other words, the first connection portion 43 and the second connection portion 47 extend in directions away from each other. The first connection portion 43 protrudes from the housing 3 outward thereof. The first connection portion 43 protrudes from the housing 3 in the first lateral direction X1. The second connection portion 47 protrudes from the housing 3 outward thereof. The second connection portion 47 protrudes from the housing 3 in the second lateral direction X2. The other configurations of the electromagnetic relay 1*b* according to the second embodiment are the same as those of the electromagnetic relay 1*a* according to the first embodiment.

Figure 5:
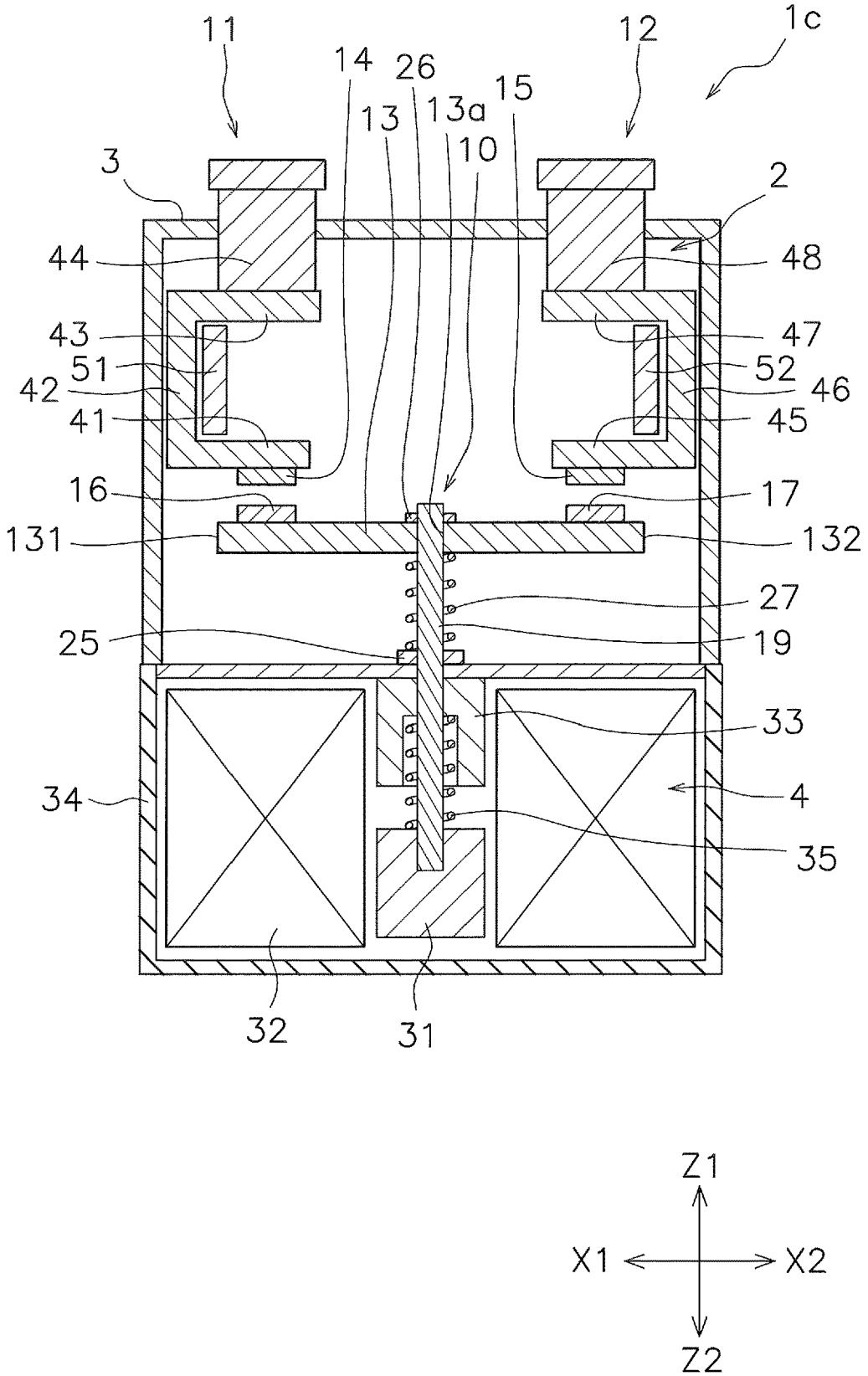
FIG. 5 is a side cross-sectional view illustrating an electromagnetic relay according to a third embodiment.

Next, an electromagnetic relay 1*c* according to a third embodiment will be described. FIG. 5 is a side cross-sectional view of the electromagnetic relay 1*c* according to the third embodiment. Among the configurations of the electromagnetic relay 1*c* according to the third embodiment, configurations that correspond to those of the electromagnetic relay 1*a* according to the first embodiment are denoted by the same reference numerals as the configurations of the electromagnetic relay 1*a* according to the first embodiment.

As illustrated in FIG. 5, the electromagnetic relay 1*c* according to the third embodiment includes a first magnetic shield member 51 and a second magnetic shield member 52. The first magnetic shield member 51 and the second magnetic shield member 52 are made of a magnetic material. The first magnetic shield member 51 is disposed between the first extending portion 42 and the movable contact piece 13 in the longitudinal direction of the movable contact piece 13. The first magnetic shield member 51 is disposed in the second lateral direction X2 with respect to the first extending portion 42. The second magnetic shield member 52 is disposed between the second extending portion 46 and the movable contact piece 13 in the longitudinal direction of the movable contact piece 13. The second magnetic shield member 52 is disposed in the first lateral direction X1 with respect to the second extending portion 46. The first magnetic shield member 51 and the second magnetic shield member 52 are disposed between the first extending portion 42 and the second extending portion 46. Other configurations of the electromagnetic relay 1*c* according to the third embodiment are similar to those of the electromagnetic relay 1*a* according to the first embodiment.

In the electromagnetic relay 1*c* according to the third embodiment, the magnetic flux generated during energization is collected in the first magnetic shield member 51 and the second magnetic shield member 52. Therefore, the magnetic flux density above the movable contact piece 13 is reduced. As a result, the Lorentz force acting on the movable contact piece 13 in the opening direction is reduced.

Figure 6:
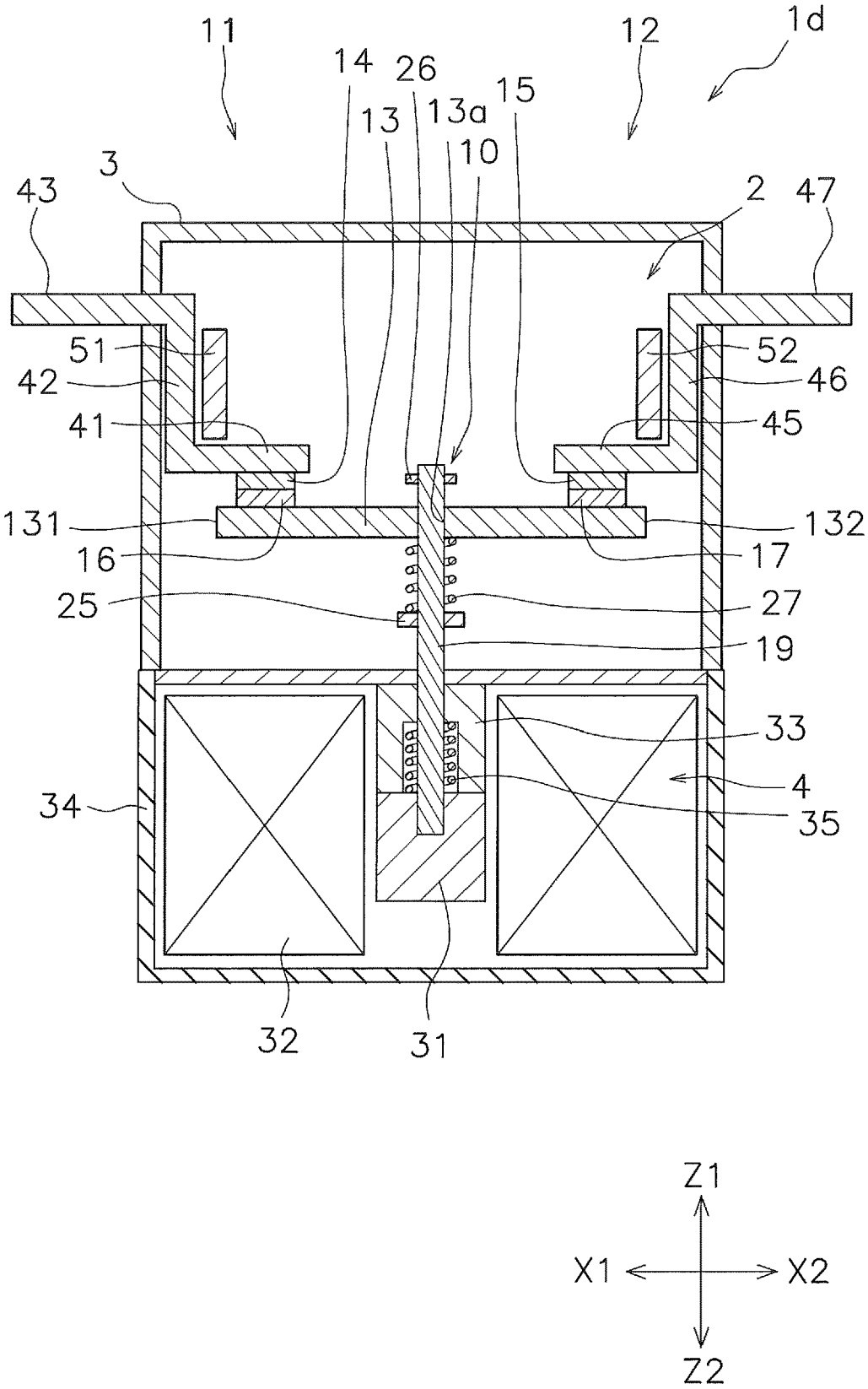
FIG. 6 is a side cross-sectional view illustrating an electromagnetic relay according to a fourth embodiment.

Next, an electromagnetic relay 1*d* according to a fourth embodiment will be described. FIG. 6 is a side cross-sectional view of the electromagnetic relay 1*d* according to the fourth embodiment. Among the configurations of the electromagnetic relay 1*d* according to the fourth embodiment, configurations that correspond to those of the electromagnetic relay 1*a* according to the first embodiment are denoted by the same reference numerals as the configurations of the electromagnetic relay 1*a* according to the first embodiment.

As illustrated in FIG. 6, the electromagnetic relay 1*d* according to the fourth embodiment includes the first fixed terminal 11 and the second fixed terminal 12 that are similar to those of the electromagnetic relay 1*b* according to the second embodiment. The electromagnetic relay 1*d* according to the fourth embodiment includes the first magnetic shield member 51 and the second magnetic shield member 52 that are similar to those of the electromagnetic relay 1*c* according to the third embodiment. Other configurations of the electromagnetic relay 1*d* according to the fourth embodiment are similar to those of the electromagnetic relay 1*b* according to the second embodiment.

In the electromagnetic relay 1*c* according to the third embodiment or the electromagnetic relay 1*d* according to the fourth embodiment described above, a first magnet and a second magnet may be disposed instead of the first magnetic shield member 51 and the second magnetic shield member 52. The first magnet and the second magnet may be permanent magnets. The first magnet and the second magnet may be disposed so as to cancel out the direction of the magnetic flux generated during energization.

Figure 7:
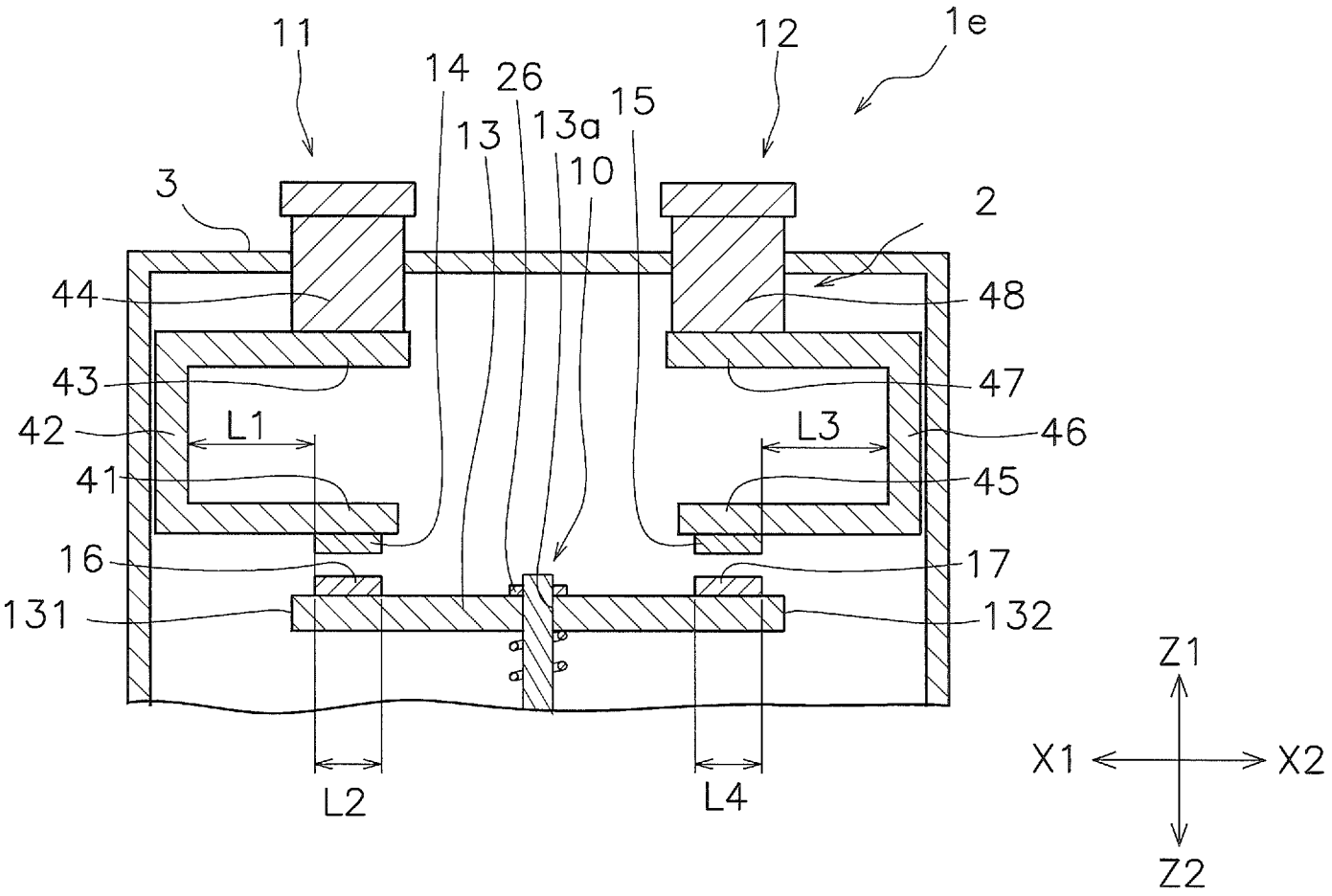
FIG. 7 is a side cross-sectional view illustrating an electromagnetic relay according to a fifth embodiment.

Next, an electromagnetic relay 1*e* according to a fifth embodiment will be described. FIG. 7 is a side cross-sectional view of the electromagnetic relay 1*e* according to the fifth embodiment. Among the configurations of the electromagnetic relay 1*e* according to the fifth embodiment, configurations that corresponds to those of the electromagnetic relay 1*a* according to the first embodiment are denoted by the same reference numerals as the configurations of the electromagnetic relay 1*a* according to the first embodiment. As illustrated in FIG. 7, in the electromagnetic relay 1*e* according to the fifth embodiment, a distance L1 between the first fixed contact 14 and the first extending portion 42 is larger than a length L2 of the contact surface between the first movable contact 16 and the first fixed contact 14. A distance L3 between the second fixed contact 15 and the second extending portion 46 is larger than a length L4 of the contact surface between the second movable contact 17 and the second fixed contact 15. Other configurations of the electromagnetic relay 1*e* according to the fifth embodiment are similar to those of the electromagnetic relay 1*a* according to the first embodiment.

Although an embodiment of the present invention has been described above, the present invention is not limited to the above embodiment, and various modifications can be made without departing from the scope of the invention.

The shape or arrangement of the first fixed terminal 11, the second fixed terminal 12, or the movable contact piece 13 may be changed. For example, the first fixed terminal 11 and the second fixed terminal 12 are not limited to a bilaterally symmetrical shape but may be asymmetrical. The shape or arrangement of the movable iron core 31, the coil 32, the fixed iron core 33, or the yoke 34 may be changed. The shape or arrangement of the first fixed contact 14, the second fixed contact 15, the first movable contact 16, and the second movable contact 17 may be changed.

The first fixed contact 14 may be separated from the first fixed terminal 11 or may be integrated therewith. The second fixed contact 15 may be separated from the second fixed terminal 12 or may be integrated therewith. The first movable contact 16 may be separated from the movable contact piece 13 or may be integrated therewith. The second movable contact 17 may be separated from the movable contact piece 13 or may be integrated therewith.

The direction in which the first connection portion 43 of the first fixed terminal 11 and the second connection portion 47 of the second fixed terminal 12 extend outward is not limited to that of the above-described embodiments. The first connection portion 43 and the second connection portion 47 may extend in the front-back direction. The first connection portion 43 and the second connection portion 47 may extend in the same direction or in different directions.

Figure 8:
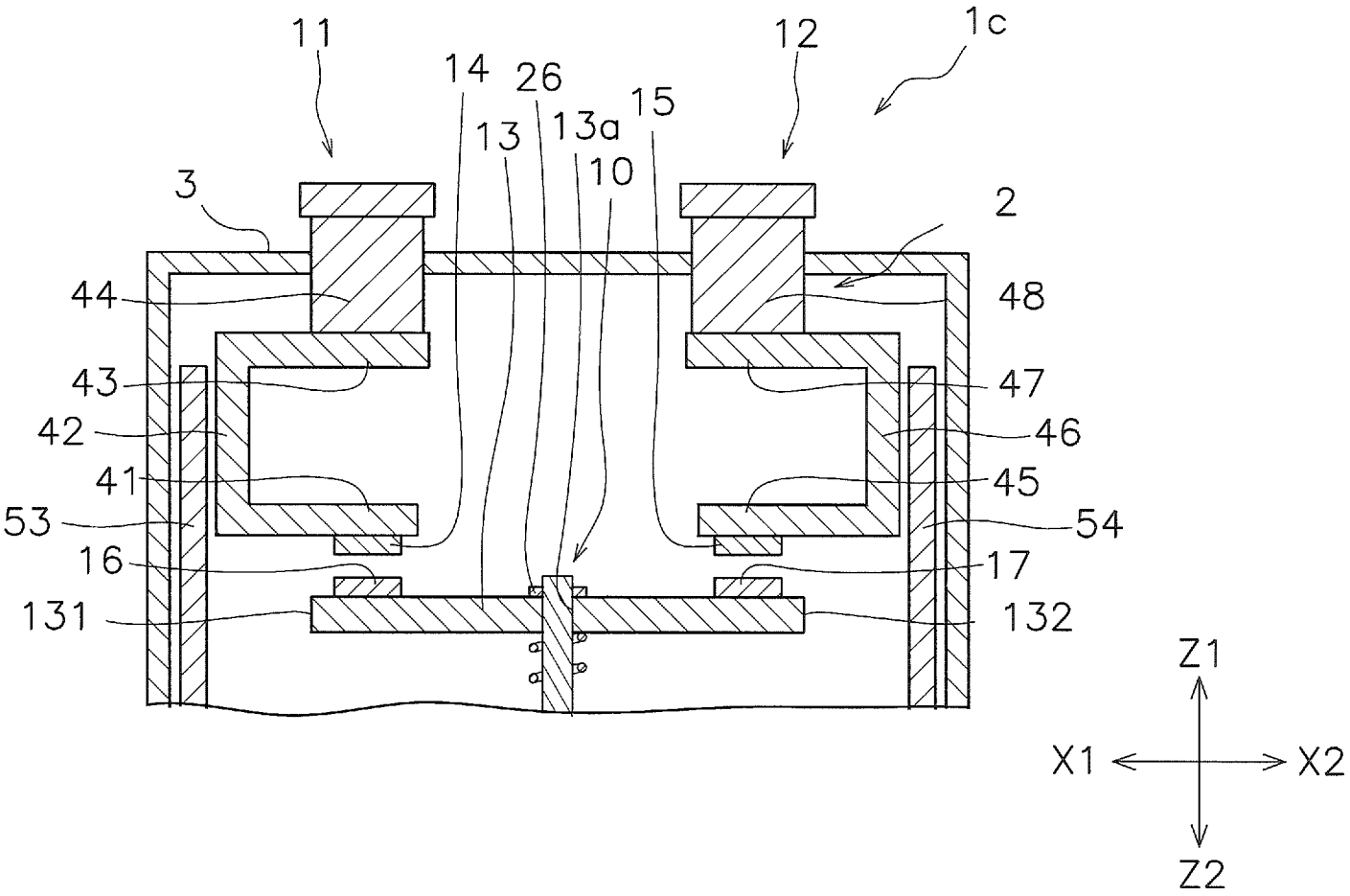
FIG. 8 is a side cross-sectional view illustrating an electromagnetic relay according to a first modified example of the arrangement of magnets.

The arrangement of the first magnet and the second magnet is not limited to the arrangement of the first magnetic shield member 51 and the second magnetic shield member 52 of the electromagnetic relay 1*c* according to the third embodiment described above and may be changed. For example, as illustrated in FIG. 8, the first magnet 53 may be disposed outside the first fixed terminal 11. The second magnet 54 may be disposed outside the second fixed terminal 12. The first magnet 53 and the second magnet 54 may be connected to the yoke 34.

Figure 9:
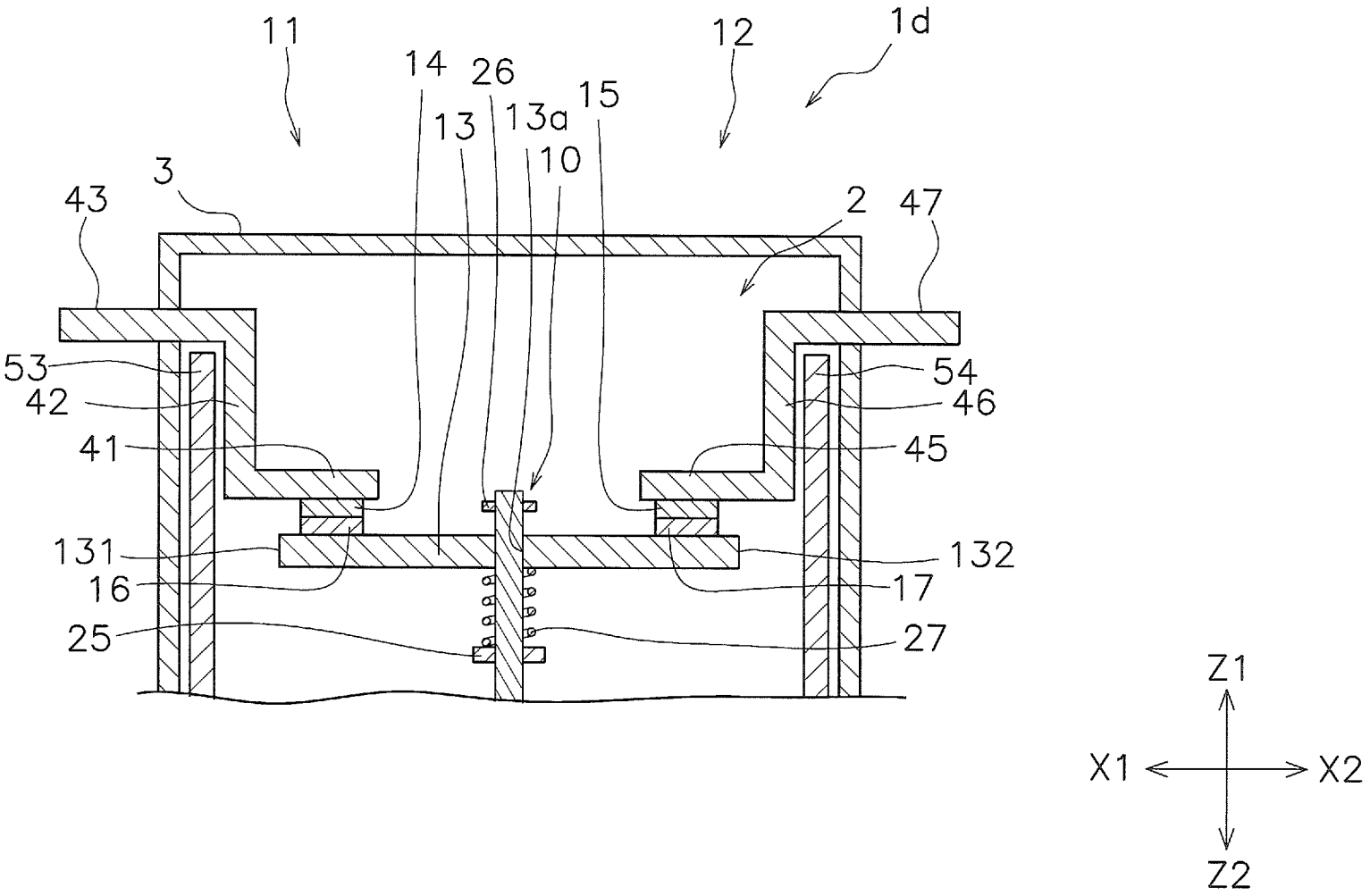
FIG. 9 is a side cross-sectional view illustrating an electromagnetic relay according to a second modified example of the arrangement of magnets.

The arrangement of the first magnet and the second magnet is not limited to the arrangement of the first magnetic shield member 51 and the second magnetic shield member 52 of the electromagnetic relay 1*d* according to the above-described fourth embodiment, and may be changed. For example, as illustrated in FIG. 9, the first magnet 53 may be disposed outside the first fixed terminal 11. The second magnet 54 may be disposed outside the second fixed terminal 12. The first magnet 53 and the second magnet 54 may be connected to the yoke 34.

Figure 10:
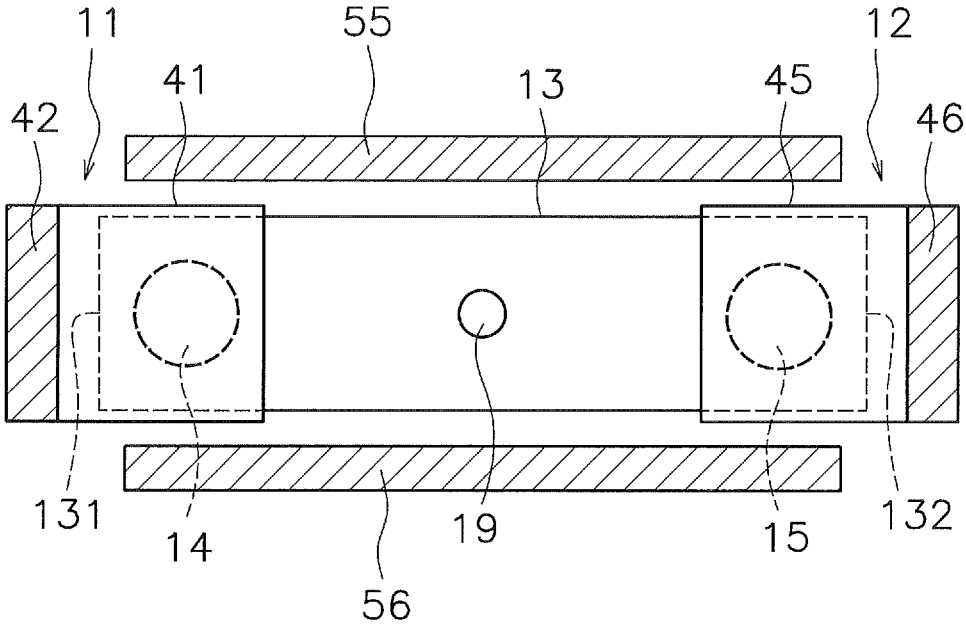
FIG. 10 is a cross-sectional view illustrating an electromagnetic relay according to a third modified example of the arrangement of magnets taken along line III-III of FIG. 1.
Figure 11:
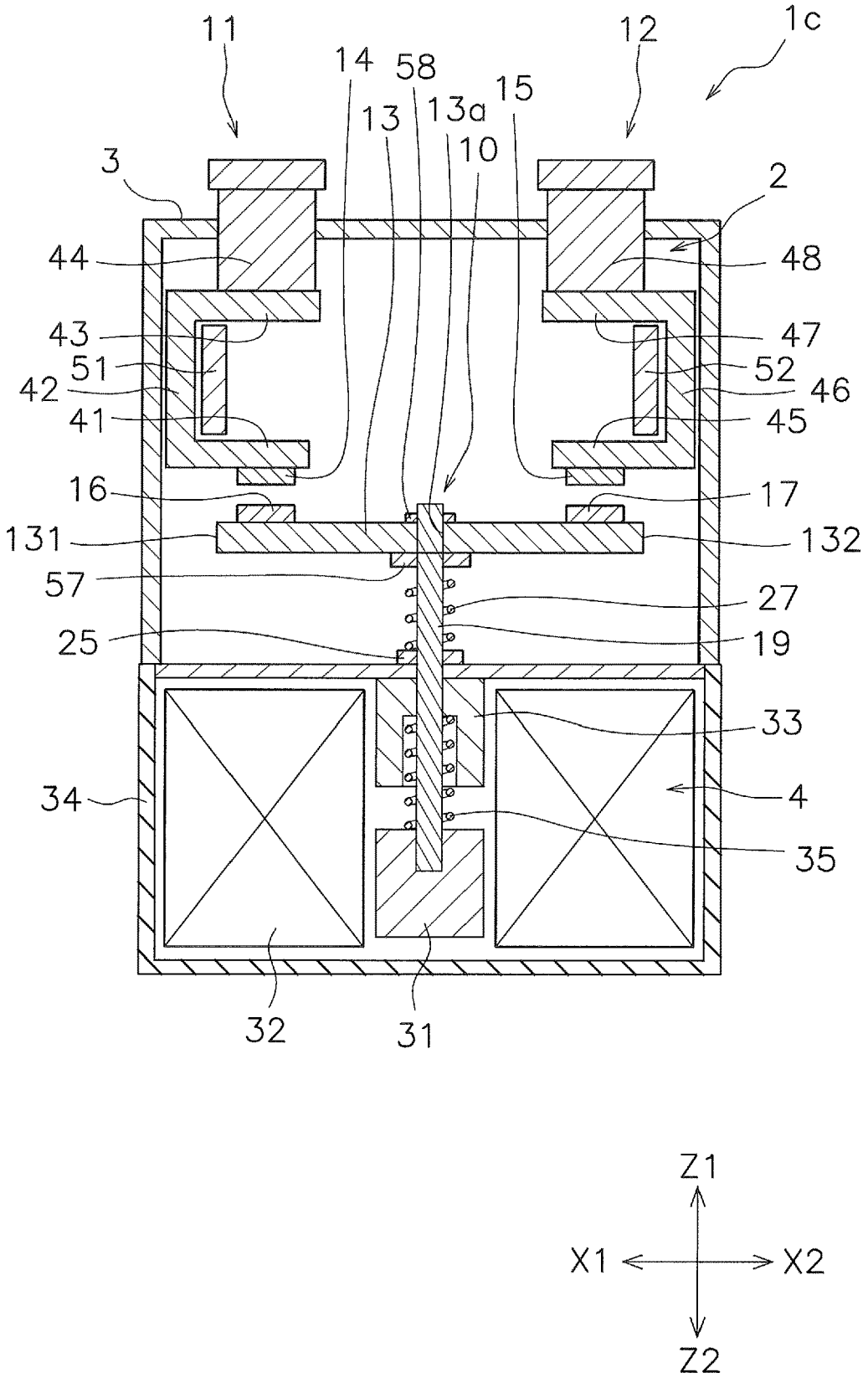
FIG. 11 is a side cross-sectional view illustrating an electromagnetic relay according to another embodiment.
Figure 12:
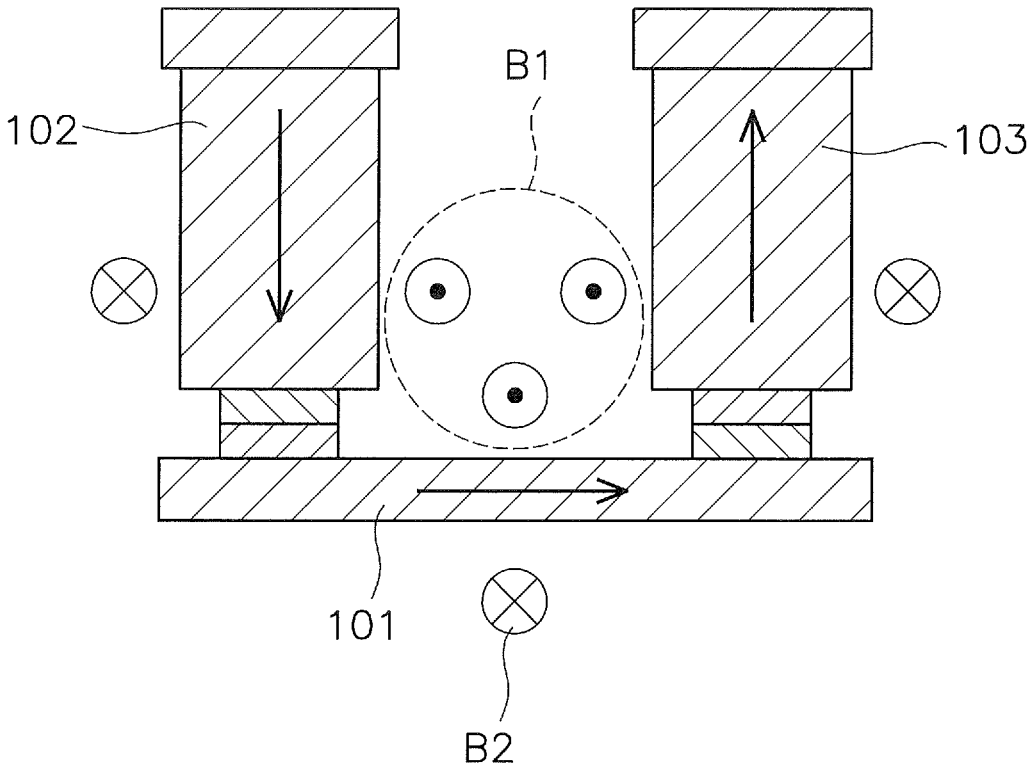
FIG. 12 is a side cross-sectional view illustrating a part of an electromagnetic relay according to a comparative example.
Figure 13:
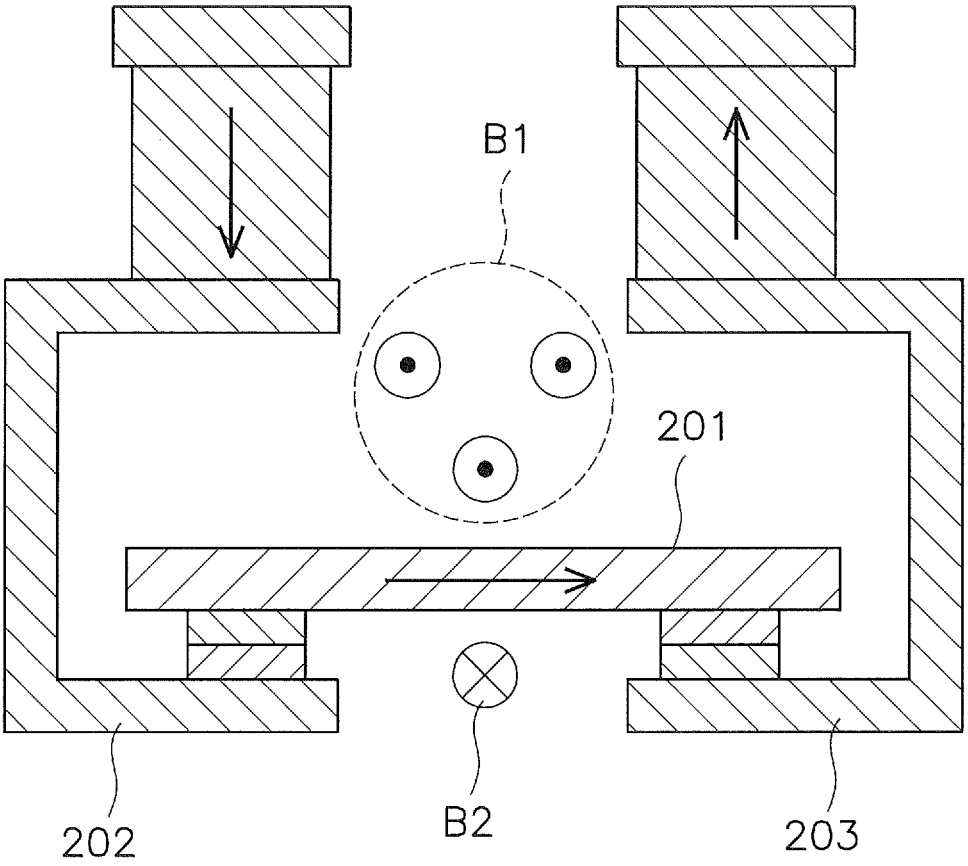
FIG. 13 is a side cross-sectional view illustrating a part of an electromagnetic relay according to another comparative example.

As illustrated in FIG. 10, the first magnet 55 and the second magnet 56 may be arranged in the front-back direction of the movable contact piece 13. As illustrated in FIG. 11, the movable mechanism 10 may include a movable yoke 57 and a fixed yoke 58. The movable yoke 57 is configured to move with respect to the drive shaft 19. The fixed yoke 58 is fixed to the drive shaft 19. When the movable contact piece 13 is energized, the movable yoke 57 and the fixed yoke 58 form a magnetic circuit. As a result, the movable contact piece 13 is held by the movable yoke 57 and the fixed yoke 58, so that the repulsion of the movable contact piece 13 is suppressed.

REFERENCE NUMERALS

10: Movable mechanism, 11: First fixed terminal, 13: Movable contact piece, 14: First fixed contact, 16: First movable contact, 19: Drive shaft, 31: Movable iron core, 32: Coils, 41: First support portion, 42: First extending portion, 43: First connection portion, 44: First external terminal, 45: Second support portion, 46: Second extending portion, 47: Second connection portion, 48: Second external terminal, 51: First magnetic shielding member, 52: Second magnetic shield member

The invention claimed is:

1. An electromagnetic relay comprising:

a movable contact piece configured to move in a closing direction and an opening direction opposite to the closing direction;

a first movable contact connected to the movable contact piece;

a second movable contact connected to the movable contact piece;

a first fixed contact disposed to face the first movable contact in the closing direction;

a second fixed contact disposed to face the second movable contact in the closing direction;

a first fixed terminal connected to the first fixed contact; and a second fixed terminal connected to the second fixed contact; wherein the first fixed terminal includes a first support portion located in the closing direction with respect to the movable contact piece, the first support portion supporting the first fixed contact, the first support portion extending from the first fixed contact in a first lateral direction that is one direction in a longitudinal direction of the movable contact piece, and a first extending portion connected to the first support portion, the first extending portion extending from the first support portion in the closing direction, the first extending portion being disposed apart from the movable contact piece in the first lateral direction, and the second fixed terminal includes a second support portion located in the closing direction with respect to the movable contact piece, the second support portion supporting the second fixed contact, the second support portion extending from the second fixed contact in a second lateral direction opposite to the first lateral direction in the longitudinal direction of the movable contact piece, and a second extending portion connected to the second support portion, the second extending portion extending from the second support portion in the closing direction, the second extending portion being disposed apart from the movable contact piece in the second lateral direction.

2. The electromagnetic relay according to claim 1, further comprising a housing accommodating the movable contact piece, the first movable contact, the second movable contact, the first fixed contact, and the second fixed contact, wherein the first fixed terminal further includes a first connection portion connected to the first extending portion, the first connection portion extending from the first extending portion in the second lateral direction, and a first external terminal connected to the first connection portion, the first external terminal protruding outward of the housing, and the second fixed terminal further includes a second connection portion connected to the second extending portion, the second connection portion extending from the second extending portion in the first lateral direction, and a second external terminal connected to the second connection portion, the second external terminal protruding outward of the housing.

3. The electromagnetic relay according to claim 1, wherein the first fixed terminal further includes a first connection portion connected to the first extending portion, the first connection portion extends from the first extending portion in the first lateral direction, the second fixed terminal further includes a second connection portion connected to the second extending portion, and the second connection portion extends from the second extending portion in the second lateral direction.

4. The electromagnetic relay according to claim 3, further comprising a housing accommodating the movable contact piece, the first movable contact, the second movable contact, the first fixed contact, and the second fixed contact, wherein the first connection portion protrudes from the housing outward of the housing, and the second connection portion protrudes from the housing outward of the housing.

5. The electromagnetic relay according to claim 1, further comprising:

a first magnet disposed so as to cancel out a direction of a magnetic flux generated in the first movable contact and the first fixed contact during energization; and a second magnet disposed so as to cancel out a direction of a magnetic flux generated in the second movable contact and the second fixed contact during energization.

6. The electromagnetic relay according to claim 1, further comprising:

a first magnetic shield member disposed between the first extending portion and the movable contact piece in the longitudinal direction of the movable contact piece; and a second magnetic shield member disposed between the second extending portion and the movable contact piece in the longitudinal direction of the movable contact piece.

7. The electromagnetic relay according to claim 1, wherein a distance between the first extending portion and the second extending portion is larger than a length of the movable contact piece in the longitudinal direction of the movable contact piece.

8. The electromagnetic relay according to claim 1, wherein a distance between the first fixed contact and the first extending portion is larger than a length of a contact surface between the first movable contact and the first fixed contact, and a distance between the second fixed contact and the second extending portion is larger than a length of a contact surface between the second movable contact and the second fixed contact.

9. The electromagnetic relay according to claim 1, wherein the first extending portion is disposed at a non-overlapping position with the movable contact piece when viewed from the closing direction or the opening direction, and the second extending portion is disposed at a non-overlapping position with the movable contact piece when viewed from the closing direction or the opening direction.

10. The electromagnetic relay according to claim 1, further comprising:

a drive shaft connected to the movable contact piece and extending from the movable contact piece in the opening direction; and a drive device disposed in the opening direction with respect to the movable contact piece; wherein the drive device includes a movable iron core connected to the drive shaft, the movable iron core being configured to move in the closing direction and the opening direction, and a coil configured to generate an electromagnetic force for moving the movable iron core.

* * * * *